US012111099B2

(12) United States Patent
Garthe

(10) Patent No.: US 12,111,099 B2
(45) Date of Patent: Oct. 8, 2024

(54) METHOD AND UNIT FOR PROCESSING A GAS MIXTURE CONTAINING NITROGEN AND METHANE

(71) Applicant: Linde GmbH, Pullach (DE)

(72) Inventor: Daniel Garthe, Wolfratshausen (DE)

(73) Assignee: Linde GmbH, Pullach (DE)

( * ) Notice: Subject to any disclaimer, the term of this patent is extended or adjusted under 35 U.S.C. 154(b) by 301 days.

(21) Appl. No.: 17/597,006

(22) PCT Filed: Jul. 10, 2020

(86) PCT No.: PCT/EP2020/025328

§ 371 (c)(1),
(2) Date: Dec. 22, 2021

(87) PCT Pub. No.: WO2021/028068

PCT Pub. Date: Feb. 18, 2021

(65) Prior Publication Data

US 2022/0316794 A1 Oct. 6, 2022

(30) Foreign Application Priority Data

Aug. 13, 2019 (EP) ..... 19020469

(51) Int. Cl.
*F25J 1/02* (2006.01)
*F25J 1/00* (2006.01)

(52) U.S. Cl.
CPC ..... *F25J 1/0015* (2013.01); *F25J 1/0022* (2013.01); *F25J 1/0072* (2013.01); *F25J 1/0214* (2013.01);
(Continued)

(58) Field of Classification Search
CPC ..... F25J 1/0015; F25J 1/028; F25J 1/0228; F25J 1/0264; F25J 1/0025; F25J 1/0212;
(Continued)

(56) References Cited

U.S. PATENT DOCUMENTS 3,559,417 A * 2/1971 Hoffman ..... F25J 3/0257 62/622
3,721,099 A * 3/1973 Forg ..... F25J 3/0209 62/623

(Continued)

FOREIGN PATENT DOCUMENTS

CN 104293404 B 8/2016
EP 2484999 A2 8/2012

*Primary Examiner* — Brian M King
(74) *Attorney, Agent, or Firm* — Millen, White, Zelano & Branigan, P.C.; Brion P. Heaney

(57) ABSTRACT

A method for processing a gas mixture containing nitrogen and methane, the gas mixture being at least partly liquefied using a mixed refrigerant circuit and is expanded in a storage tank, wherein: formed in the storage tank are a liquid phase, which is depleted in nitrogen and enriched with methane relative to the gas mixture, and a vapour phase, which is enriched with nitrogen and depleted in methane relative to the gas mixture; at least some of the vapour phase is compressed, at least partly liquefied, and subjected to low-temperature rectification; and formed in the low-temperature rectification are a top gas rich in nitrogen and lean in methane, and a bottom liquid lean in nitrogen and rich in methane. The invention provides that the partial liquefaction of the vapour phase is caused by cooling by means of heat exchange using the mixed refrigerant circuit.

17 Claims, 1 Drawing Sheet

(52) U.S. Cl.
CPC ..... *F25J 2210/42* (2013.01); *F25J 2210/60* (2013.01); *F25J 2290/12* (2013.01)

(58) Field of Classification Search
CPC ..... F25J 3/0257; F25J 3/0209; F25J 2210/42; F25J 2215/44; F25J 2245/90; F25J 2210/90; F25J 2220/62
See application file for complete search history.

(56) References Cited

U.S. PATENT DOCUMENTS

| | | | | |
|---|---|---|---|---|
| 3,857,251 | A * | 12/1974 | Alleaume | F25J 1/0045 62/623 |
| 4,017,283 | A * | 4/1977 | Witt | F25J 1/025 62/50.7 |
| 9,816,754 | B2 | 11/2017 | Chem | |
| 2012/0060554 | A1* | 3/2012 | Schmidt | C10L 3/105 62/620 |
| 2012/0198883 | A1* | 8/2012 | Bauer | F25J 3/0209 62/600 |
| 2014/0260415 | A1* | 9/2014 | Ducote, Jr. | F25J 1/0212 165/104.21 |
| 2015/0308736 | A1* | 10/2015 | Chen | F25J 3/0233 62/623 |
| 2015/0308738 | A1 | 10/2015 | Ott et al. | |
| 2017/0234611 | A1* | 8/2017 | White | F25J 3/0209 62/639 |

* cited by examiner

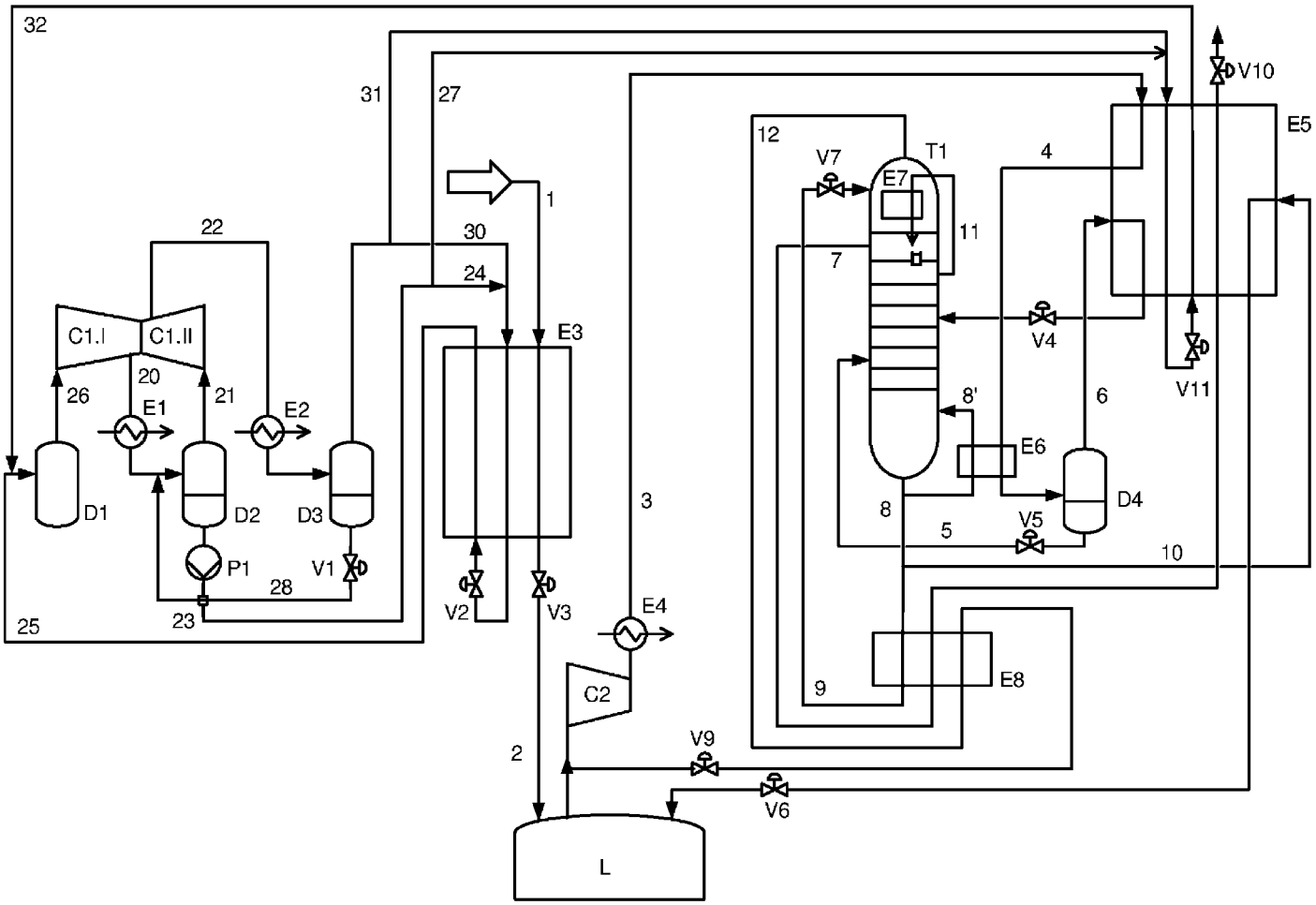
E5
V10
V11
10
D4
6
4
V4
E6
V5
E8
11
8'
T1
5
E7
8
V7
7
9
12
V6
V9
3
E4
C2
L
E3
V3
1
2
V2
30
24
27
31
D3
V1
E2
28
D2
P1
22
21
23
C1.II
20
E1
C1.I
26
D1
32
25

METHOD AND UNIT FOR PROCESSING A GAS MIXTURE CONTAINING NITROGEN AND METHANE

The present invention relates to a method for processing a gas mixture containing nitrogen and methane,

- wherein the gas mixture is at least partly liquefied using a mixed refrigerant circuit and expanded in a storage tank,
- wherein a liquid phase, which is depleted in nitrogen and enriched with methane relative to the gas mixture, and a vapor phase, which is enriched with nitrogen and depleted in methane relative to the gas mixture, are formed in the storage tank,
- wherein at least some of the vapor phase is compressed, at least partly liquefied, and subjected to low-temperature rectification,
- wherein a top fraction rich in nitrogen and lean in methane and a bottom liquid lean in nitrogen and rich in methane are formed in the low-temperature rectification, and
- wherein the liquefaction of the gas mixture containing nitrogen and methane and the partial liquefaction of the vapor phase take place using a single, mixed refrigerant circuit.

A generic method for processing a gas mixture containing nitrogen and methane is known from US patent application 2015/0308738, FIG. 2.

In natural gas liquefaction, mixed refrigerants consisting of different hydrocarbon components and nitrogen are usually used. In particular, one, two, or even three mixed refrigerant circuits are used; furthermore, mixed refrigerant circuits with propane precooling are known.

Natural gas can, in particular, have more than 70 and preferably more than 90 mol % methane and, in the remainder, non-hydrocarbon gases, such as water, nitrogen, and acid gases. They may also contain higher hydrocarbons—in particular, ethane. The content of hydrocarbons having three or more carbon atoms, such as propane, butane, pentane, etc., are, in particular, is less than 10 mol %. Natural gas also typically comprises noble gases and, possibly, hydrogen.

Prior to the liquefaction of natural gas, hydrocarbons having at least three carbon atoms (so-called "heavy" hydrocarbons, or HHC), water, and acid gases are removed from the natural gas in order to avoid condensation or solidification during liquefaction. A natural gas prepared for liquefaction is, therefore, typically substantially free of water and/or carbon dioxide and predominantly contains methane and nitrogen, as well as, possibly, ethane and other non-hydrocarbons—in particular, hydrogen and helium—which have a lower boiling point than methane. In order to obtain a liquefied natural gas according to the specification, it may be necessary to also remove the nitrogen and the other non-hydrocarbons.

Although the present invention is described below predominantly with reference to the liquefaction of natural gas, the proposed measures are in principle also suitable for liquefying other gas mixtures containing methane and nitrogen—in particular, gas mixtures which are substantially free of water, carbon dioxide, and lean in hydrocarbons having three or more carbon atoms and lean in other components having a higher boiling point than methane or ethane. Therefore, when reference is made below to "liquefied gas" or "liquefied natural gas," or to a "gas mixture" or to "natural gas," these terms can be understood synonymously. The term, "inert components," used below includes, in particular, nitrogen, hydrogen, and helium.

Here, "lean in" is understood to mean a content of typically less than 2 mol %, and "substantially free of" is understood to mean a content of less than 1 mol-ppm for water and less than 50 mol-ppm for carbon dioxide. The content of nitrogen in a gas mixture treated according to the invention can, in particular, be more than 1 and up to 10 mol %, wherein the methane content in the remainder can, for example, be more than 80 and up to 95 mol %.

In the liquefaction of natural gas or a corresponding other gas mixture, it is condensed to liquid (natural) gas using a heat exchanger or another cooling device and fed into a liquid (natural) gas storage tank. When the liquid gas is fed into the storage tank and during storage, partial evaporation occurs, due, inter alia, to heat input from the outside, wherein the vapor phase is enriched with components having a lower boiling point or high higher vapor pressure than methane with respect to the liquid phase and is depleted in components having a high higher boiling point or lower vapor pressure than methane—for example, in ethane.

If the vapor phase is removed from the storage tank continuously or periodically, the liquid gas is thus depleted in the components having a lower boiling point than methane—in particular, in nitrogen. This increases the purity of the liquid gas in the storage tank. Such purification can also be carried out in a targeted manner by the use of suitable feed and storage conditions, e.g., an expansion or the adjustment of adapted pressure and/or temperature conditions.

The extracted vapor phase, which, in addition to the components having a lower boiling point than methane—in particular, nitrogen—also contains a high proportion of methane, can be used as fuel to provide the energy required in the process. Any excess vapor phase can also be discharged from the method via a flare. If a lot of nitrogen, comparatively, is contained in the liquefied gas formed during liquefaction (e.g., more than 1%), additional measures for reducing the nitrogen content in the liquefied gas may become necessary. The reason for this lies in the fact that, although in such cases a sufficient purity of the liquid gas can also be achieved by evaporation, the vapor phase cannot, however, readily be used in the manner explained or should not be used for reasons of efficiency, or is simply precipitated in too large a quantity, and a lot of methane is lost therein. Therefore, in cases of such high nitrogen contents, all of the gas mixture processed in the liquefaction, or even just the vapor phase from the storage tank, for example, can be subjected to fractional distillation in order to separate off nitrogen accordingly, as disclosed in US patent application 2015/0308738. The remaining methane can be returned to the liquefaction or, if it occurs in the liquid state, to the storage tank.

The aim of the present invention is to specify a method according to the preamble for processing a gas mixture containing nitrogen and methane—in particular, natural gas—which method facilitates a more efficient procedure compared to the method known from US patent application 2015/0308738.

In order to achieve this aim, the invention proposes a generic method for processing a gas mixture containing nitrogen and methane, characterized in that

- the liquefaction of the gas mixture containing nitrogen and methane and the partial liquefaction of the vapor phase take place in separate heat exchangers,
- a partial stream of the sump liquid drawn off from the low-temperature rectification is at least partly vaporized against a top gas drawn off from the low-temperature rectification, and the at least partly condensed top gas is supplied to the low-temperature rectification as a return stream, and the top fraction drawn off from the low-temperature rectification has a nitrogen content of at least 99 mol %.

Advantageous embodiments of the method according to the invention are the subject matter of the dependent claims and the following description.

The method according to the invention for processing a gas mixture containing nitrogen and methane now facilitates optimal temperature control adapted to the respective method conditions in the separate heat exchangers to be provided for liquefying the gas mixture containing nitrogen and methane and partly liquefying the vapor phase. Furthermore, the method according to the invention makes it possible to obtain a pure nitrogen fraction having a nitrogen content of at least 99 mol %, without requiring an additional compressor for this purpose, as is the case with the method according to US patent application 2015/0308738.

As mentioned several times, the gas mixture treated in the method proposed according to the invention (i.e., the feed gas) can, in particular, be natural gas or a gas mixture formed using natural gas. The formation of the gas mixture from natural gas may comprise, in particular, drying, deacidification, and removal of hydrocarbons having three or more carbon atoms in the manner explained at the outset and known from the prior art.

In the method according to the invention, the gas mixture used, which contains nitrogen and methane, is at least partly liquefied—in particular, at a pressure level of 25 to 90 bar. The storage tank is, advantageously, operated at a pressure level of 1 to 5 bar. Low-temperature rectification can be carried out, in particular, at a pressure level of 15 to 30 bar.

In the method, in the mixed refrigerant circuit, a mixed refrigerant is, advantageously, provided in a receiving vessel and fed to an intercooler via a first compression stage or compression unit of a refrigerant compressor. The compressed, mixed refrigerant is cooled in the intercooler and fed to a first refrigerant separator. A first refrigerant gas phase and a first refrigerant liquid phase are formed in the first refrigerant separator. The first refrigerant gas phase is fed to a second compression stage or compression unit of the refrigerant compressor, compressed, and fed to a second refrigerant separator after cooling in an aftercooler. A second refrigerant gas phase and a second refrigerant liquid phase are formed in the second refrigerant separator, wherein the second refrigerant liquid phase is returned to the first refrigerant separator, and wherein, in the separate heat exchangers serving the at least partial liquefaction of the gas mixture and of the vapor phase, a partial stream of the first refrigerant liquid phase in each case, together with a partial stream of the second refrigerant gas phase in each case, is subcooled by heat exchange, expanded, and used as refrigerant for the respective heat exchange. After heat exchange in the two heat exchangers, the mixtures of the first refrigerant liquid phase and the second refrigerant gas phase are returned to the receiving vessel.

The use of the previously described cold mixture circuit for the at least partial liquefaction of the gas mixture containing nitrogen and methane and the partial liquefaction of the vapor phase in separate heat exchangers enables the refrigerant composition to be flexibly adjusted for the separate heat exchangers by means of the different mixing of the first refrigerant liquid phase and the second refrigerant gas phase, and thereby facilitates the independent adjustment of the process temperatures in the separate heat exchangers.

In particular, the mixed refrigerant can consist of a proportion of more than 95% of the components nitrogen, methane, ethane and/or ethylene, propane, butane and pentane, and isomers thereof. Different mixed refrigerant circuits can also be used, e.g., mixed refrigerant circuits having several mixed refrigerants or having pure substance refrigerants, such as propane-precooled, mixed refrigerant circuits, as are known from the prior art.

The method according to the invention for processing a gas mixture containing nitrogen and methane and further embodiments thereof are explained in more detail below with reference to the FIGURE.

The gas mixture 1, e.g., natural gas, which is to be processed and which contains nitrogen and methane, is cooled against the refrigerant of a mixed refrigerant circuit by heat exchange in a heat exchanger E3 and at least partly liquefied. This mixture 2 is then expanded in a storage tank L via a valve V3.

The refrigerant against which the gas mixture 1 is cooled by heat exchange originates from a mixed refrigerant circuit in which a mixed refrigerant 26 is provided in a receiving vessel D1. This mixed refrigerant has the composition explained above. The mixed refrigerant is compressed 20 to an intermediate pressure via a first compressor stage or compressor unit C1.I of a refrigerant compressor and then cooled in an intercooler E1 and partly condensed. In a refrigerant separator D2, a first refrigerant gas phase 21 and a first refrigerant liquid phase 23 are separated from one another, and the first refrigerant gas phase 21 is compressed 22 to the circuit pressure via a second compressor stage or compressor unit C1.II of the refrigerant compressor and cooled in an aftercooler E2 and partly condensed. In a refrigerant separator D3, a second refrigerant gas phase 29 and a second refrigerant liquid phase 28 are separated from one another. The second refrigerant liquid phase 28 is expanded in the partly condensed refrigerant feed 20 via the expansion valve V1 upstream of the refrigerant separator D2. The first refrigerant liquid phase 23 is increased in pressure in a pump P1 to the circuit pressure, and a partial stream thereof, together with a first partial stream 30 of the second refrigerant gas phase 29, is used as refrigerant for the heat exchange with the gas mixture 1, containing nitrogen and methane, in the heat exchanger E3. For this purpose, it is first subcooled in the heat exchanger E3, expanded in the expansion valve V2, and guided through the heat exchanger E3 via the line 25 back into the receiving vessel D1.

After expansion V3 of the at least partly liquefied mixture 2 and by means of the introduction of heat from the outside, an almost binary vapor phase 3, consisting of methane and enriched inert components, is formed in the storage tank L, which binary vapor phase is compressed by means of a compressor C2—preferably, to a pressure between 15 and 30 bar—and cooled in the coolers E4 and E5. The cooled vapor phase 4 is subsequently partly liquefied in the downstream sump boiler E6 of the separation column T1, and the resulting gas fraction 6 is fed to the heat exchanger E5 for further condensation and subcooling after separation in the separator D4. According to the invention, the provision of cold in the heat exchanger E5 likewise takes place via the previously described mixed refrigerant circuits, wherein a partial stream 27 of the first refrigerant liquid phase 23 pumped up to the circuit pressure, together with a second partial stream 31 of the second refrigerant gas phase 29, is used as refrigerant for the heat exchange with the method streams to be cooled. For this purpose, the aforementioned, combined partial streams 27 and 31 are first subcooled in the heat exchanger E5, expanded in the expansion valve V11, and guided through the heat exchanger E5 via the line 32 back into the receiving vessel D1.

The partly liquefied stream 4 is separated in the separator D4 into a vapor phase 6 and a liquid phase 5, wherein the liquid phase is fed from the separator directly into the separation column T1, while the vapor phase is further liquefied in the heat exchanger E5 before it is likewise fed into the separation column T1 via the expansion valve V4.

Sump liquid 8, which mainly contains methane, is removed from the separation column T1 and evaporated via the sump boiler E6 to yield a first part 8', and returned to the sump of the separation column T1, cooled to yield a second part 10 via the heat exchanger E5 and returned to the storage tank L via the expansion valve V6, and cooled to yield a third part 9 via a subcooler E8 and used as coolant after expansion in the valve V 7 in the head condenser E7 of the separation column T1. The third part of the sump liquid is evaporated thereby in the head condenser E7, supplied via line 12 to the subcooler E8 in which it acts as a coolant, and subsequently returned via the expansion valve V9 before the compression C2 of the vapor phase 3. A gas 11, which is rich in nitrogen, possibly contains further inert components, and is low in methane, is removed from the separation column T1, cooled via the head condenser E7, and at least partly condensed and returned as return flow into a head section of the nitrogen separation column T1. The nitrogen-rich top gas 7 from the separation column T1 is discharged, via the subcooler E8 and the heat exchanger E5—in both of which it acts as coolant—as a nitrogen product stream having a content of nitrogen and, possibly, further inert components of at least 99 mol %, out of the process via the expansion valve V10.

The use of the mixed refrigerant circuit according to the invention for both the at least partial liquefaction of the gas mixture containing nitrogen and methane in the heat exchanger E3, and the distillative separation of the nitrogen and, possibly, further inert components from the vapor phase formed in the storage tank, and the at least partial liquefaction of the vapor phase in the heat exchanger E5 taking place for this purpose, has the advantage that the temperature in the heat exchangers E3 and E5 with the mixed refrigerant circuit can be precisely adjusted, and an economical process control is thus facilitated. By means of suitable method conditions, different temperatures can be realized in the heat exchangers E3 and E5 which are supplied via the mixed refrigerant circuit, so that the two method steps can be operated at the ideal temperature in each case—in particular, by adjusting an ideal mixing ratio of the first refrigerant liquid phase and the second refrigerant gas phase respectively, as well as different amounts of refrigerant, even though they are supplied via the same cooling circuit.

The method according to the invention also facilitates the production of a methane-rich liquid stream 10, which is supplied to the storage tank L via valve V6 as described.

By using an almost pure sump stream 9, the methane content of which is typically more than 95 mol %, the pressure-expanded sump stream is evaporated in the heat exchanger E7 at an almost constant temperature in order to produce a reflux for the separating column T1. As a result, the head condenser can be designed as a heat exchanger seated in a liquid bath. This leads to a very robust design of the heat exchanger and, additionally, to stable operating conditions. An enrichment of heavier hydrocarbons in the stream to be evaporated in the heat exchanger E7 can, additionally, be easily prevented by extracting a small amount of liquid stream—preferably, less than 5% of the amount of stream 9—from the upper part of the separating column T1.

The invention claimed is:

1. A method for processing a gas mixture containing nitrogen and methane, wherein the gas mixture is at least partly liquefied using a mixed refrigerant circuit, expanded, and introduced into a storage tank, wherein a liquid phase, which is depleted in nitrogen and enriched with methane relative to the gas mixture, and a vapor phase, which is enriched with nitrogen and depleted in methane relative to the gas mixture, are formed in the storage tank, wherein at least some of the vapor phase is withdrawn from the storage tank, compressed, at least partly liquefied using a mixed refrigerant circuit, and subjected to low-temperature rectification, wherein a top fraction rich in nitrogen and lean in methane and a bottom liquid lean in nitrogen and rich in methane are formed in the low-temperature rectification, and the top fraction is withdrawn from the low-temperature rectification, and wherein the liquefaction of the gas mixture containing nitrogen and methane and the at least partial liquefaction of the vapor phase are both performed using a single, mixed refrigerant circuit, wherein the liquefaction of the gas mixture containing nitrogen and methane is performed in a first heat exchanger and the at least partial liquefaction of the vapor phase is performed in a first second exchanger wherein said first heat exchanger and said second heat exchanger are separate heat exchangers, a partial stream of the bottom liquid is withdrawn from the low-temperature rectification, at least partly vaporized by heat exchange with a top gas drawn off from the low-temperature rectification, and the top gas is at least partially condensed and supplied to the low-temperature rectification as a return stream, wherein, in the mixed refrigerant circuit, the mixed refrigerant is split into a first refrigerant gas phase, a first refrigerant liquid phase, a second refrigerant gas phase, and a second refrigerant liquid phase, wherein a first partial stream of the first refrigerant liquid phase is combined with a first partial stream of the second refrigerant gas phase and used as refrigerant in the first heat exchanger, and a second partial stream of the first refrigerant liquid phase is combined with a second partial stream of the second refrigerant gas phase and used as refrigerant in the second heat exchanger, and the top fraction withdrawn from the low-temperature rectification has contains inert component(s) comprising nitrogen, and the concentration of all inert components, including nitrogen, in the withdrawn top fraction is at least 99 mol %.

2. The method according to claim 1, wherein the withdrawn top fraction contains hydrogen and/or helium.

3. The method according to claim 1, wherein another partial stream of the bottom liquid withdrawn from the low-temperature rectification is cooled against the withdrawn top fraction, which is thereby heated, and said another partial stream of the bottom liquid is sent to the storage tank.

4. The method according to claim 1, wherein the vapor phase withdrawn from the storage tank is partially liquefied and this partial liquefaction is assisted by using the vapor phase to heat the top fraction withdrawn from the low-temperature rectification, and wherein vapor and liquid fractions formed by the partial liquefaction of the vapor phase withdrawn from the storage tank are separated from one another and fed to the low-temperature rectification at different feed positions.

5. The method according to claim 1, wherein the partial stream of the bottom liquid withdrawn from the low-temperature rectification, before being at least partly vaporized against the top gas drawn off from the low-temperature rectification, is cooled against the top fraction withdrawn from the low-temperature rectification in a subcooler, the resultant cooled partial stream of the bottom liquid is expanded and evaporated and introduced into a head condenser of the low-temperature rectification in which the cooled partial stream of the bottom liquid acts as a coolant, and the evaporated partial stream of the bottom liquid is used as further coolant in the subcooler, wherein the evaporated partial stream of the bottom liquid, after being used as the further coolant in the subcooler, is combined with the vapor phase from the storage tank before compression of the vapor phase.

6. The method according to claim 1, wherein, in the mixed refrigerant circuit, a mixed refrigerant is provided in a receiving vessel and fed to an intercooler via a first compression stage of a refrigerant compressor, wherein the compressed mixed refrigerant is cooled in the intercooler and fed to a first refrigerant separator, wherein the first refrigerant gas phase and the first refrigerant liquid phase are formed in the first refrigerant separator, wherein the first refrigerant gas phase is supplied to a second compression stage of the refrigerant compressor compressed, and, after cooling in an aftercooler, is fed to a second refrigerant separator, wherein the second refrigerant gas phase and the second refrigerant liquid phase are formed in the second refrigerant separator, and wherein the second refrigerant liquid phase is returned to the first refrigerant separator.

7. The method according to claim 6, wherein the compositions and/or volume streams of the first and/or second refrigerant gas phases and/or refrigerant liquid phases can be controlled.

8. The method according to claim 1, wherein the gas mixture is natural gas or a gas mixture formed using natural gas.

9. The method according to claim 1, wherein the at least partial liquefaction of the gas mixture is carried out at a pressure level of 25 to 90 bar, the storage tank is operated at a pressure level of 1 to 5 bar, and/or the low-temperature rectification is carried out at a pressure level of 15 to 30 bar.

10. The method according to claim 1, wherein the mixed refrigerant contains more than 95% nitrogen, methane, ethane and/or ethylene, propane, butane and/or pentane, and isomers thereof.

11. The method according to claim 1, wherein the top fraction withdrawn from the low-temperature rectification has a nitrogen content of at least 99 mol %.

12. The method according to claim 1, wherein, before being used as refrigerant in the first heat exchanger, the combined first partial stream of the first refrigerant liquid phase and first partial stream of the second refrigerant gas phase is subcooled and expanded.

13. The method according to claim 1, wherein, before being used as refrigerant in the second heat exchanger, the combined second partial stream of the first refrigerant liquid phase and second partial stream of the second refrigerant gas phase is subcooled and expanded.

14. The method according to claim 1, wherein, after being used as refrigerant in the first heat exchanger, the combined first partial stream of the first refrigerant liquid phase and first partial stream of the second refrigerant gas phase is sent to a receiving vessel, and, after being used as refrigerant in the second heat exchanger, the combined second partial stream of the first refrigerant liquid phase and second partial stream of the second refrigerant gas phase is sent to the receiving vessel.

15. The method according to claim 6, wherein, before being used as refrigerant in the first heat exchanger, the combined first partial stream of the first refrigerant liquid phase and first partial stream of the second refrigerant gas phase is subcooled and expanded.

16. The method according to claim 6, wherein, before being used as refrigerant in the second heat exchanger, the combined second partial stream of the first refrigerant liquid phase and second partial stream of the second refrigerant gas phase is subcooled and expanded.

17. The method according to claim 6, wherein, after being used as refrigerant in the first heat exchanger, the combined first partial stream of the first refrigerant liquid phase and first partial stream of the second refrigerant gas phase is sent to the receiving vessel, and, after being used as refrigerant in the second heat exchanger, the combined second partial stream of the first refrigerant liquid phase and second partial stream of the second refrigerant gas phase is sent to the receiving vessel.

* * * * *